United States Patent [19]

Owen et al.

[11] Patent Number: 4,821,914

[45] Date of Patent: Apr. 18, 1989

[54] LOW TEMPERATURE STORAGE CONTAINER FOR TRANSPORTING PERISHABLES TO SPACE STATION

[75] Inventors: James W. Owen; William G. Dean, both of Huntsville, Ala.

[73] Assignee: The United States of America as represented by the Administrator of the National Aeronautics and Space Administration, Washington, D.C.

[21] Appl. No.: 176,545

[22] Filed: Apr. 1, 1988

[51] Int. Cl.[4] ..... B65D 25/18

[52] U.S. Cl. ..... 220/421; 62/371; 62/457; 220/467

[58] Field of Search ..... 62/45, 371, 457; 220/5 A, 412, 420, 421, 423, 452, 466, 467

[56] References Cited

U.S. PATENT DOCUMENTS

| | | | |
|---|---|---|---|
| 1,518,668 | 12/1924 | Mitchell | 220/420 |
| 1,521,148 | 12/1924 | Dennett et al. | 220/421 |
| 3,446,388 | 5/1969 | Greenberg | 220/421 |
| 3,461,678 | 8/1969 | Klipping et al. | 220/421 |
| 3,603,107 | 9/1971 | Elliott et al. | 220/421 |
| 3,713,560 | 1/1973 | Slysh et al. | 220/420 |
| 4,300,356 | 11/1981 | Notaro et al. | 62/457 |
| 4,343,413 | 8/1982 | Chatzipetros et al. | 220/420 |
| 4,646,934 | 3/1987 | McAllister | 220/420 |

FOREIGN PATENT DOCUMENTS

| | | | |
|---|---|---|---|
| 1213442 | 6/1957 | Fed. Rep. of Germany | 220/420 |
| 0385503 | 5/1908 | France | 220/420 |

*Primary Examiner*—Jimmy G. Foster

*Attorney, Agent, or Firm*—William J. Sheehan; John R. Manning; Charles E. B. Glenn

[57] ABSTRACT

Two storage containers are disclosed within which food or biological samples may be stored for transfer in a module by the space shuttle to a space station while maintaining the food or samples at very low temperatures. The container is formed in two parts, each part having an inner shell and an outer shell disposed about the inner shell. The space between the shells is filled with a continuous wrap multi-layer insulation and a getter material. The two parts of the container have interlocking members and when connected together are sealed for preventing leakage from the space between the shells. After the two parts are filled with frozen food or samples they are connected together and a vacuum is drawn in the space between the shells and the container is stored in the module. For the extremely low temperature requirements of biological samples, an internal liner having a phase change material charged by a refrigerant coil is disposed in the space between the shells, and the container is formed from glass fiber material including honeycomb structural elements. All surfaces of the glass fiber which face the vacuum space are lined with a metal foil.

17 Claims, 2 Drawing Sheets

LOW TEMPERATURE STORAGE CONTAINER FOR TRANSPORTING PERISHABLES TO SPACE STATION

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

This invention relates to long term storage of frozen and refrigerated food and biological samples, and more particularly to a passive system including a storage container having high thermal efficiency for storage of such materials at low temperatures for extended periods of time for use in conjunction with a manned space station.

The manned space station being developed by the NASA requires both refrigerated and frozen food for supporting and sustaining the crew, and in all probability the life science experimentation mission will require frozen biological samples. Such food and samples will be required to be transported to and from the space station. Other materials to be processed by the crew may also be required to be maintained under refrigerated or frozen conditions. The number of fluid and thermal interfaces which would be required for the low temperature requirements during the various mission phases of the logistics module appear to make the demands of such active refrigeration system interfaces unfeasibly prohibitive for accommodation by the logistics module.

For example, the low temperature requirements would have to be provided by ground support equipment prior to launch, but during ascent and orbit in the shuttle, an interface between the module and the shuttle would be required. Additionally, during transit from the shuttle to the space station, the logistics module itself would be required to provide these requirements without a separate support system. While at the space station an interface between the logistics module and the space station would be required to maintain the low temperature requirements. And finally, during descent and landing, an interface would again be required between the logistics module and the shuttle.

In view of the difficulties, both technological and economic, envisioned for such a large number of active interfaces, a passive system eliminating the fluid/thermal interfaces and associated electrical interfaces appears necessary for mission purposes.

SUMMARY OF THE INVENTION

Consequently, it is a primary object of the present invention to provide a passive system for long term storage capability for maintaining food and experimentation samples at the low temperatures required for preservation.

It is another object of the present invention to provide a passive thermally efficient low temperature storage system for elimination of active fluid and thermal interfaces for transporting food and biological samples through the various mission phases from earth to a manned space station.

It is a further object of the present invention to provide a thermally efficient storage container capable of maintaining low temperatures for extended periods of time without an active refrigeration system interface.

Accordingly, the present invention provides a storage container within which food or experimentation samples may be stored, the container being formed in two parts, each part having an inner shell about the storage section and an outer shell spaced from and about the inner shell, the space between the shells being filled with a continuous wrap multi-layer insulation and a getter material. The two parts of the container have interlocking members including seals for preventing leakage into the space between the walls. After the two parts of the container are filled with frozen material, they are connected together and a vacuum is drawn in the space between the shells. The container may thereafter be stored in the logistics module. The space between the shells may include an internal liner having a phase change material and the liner may include a charged refrigerant coil for freezing and solidifying the phase change material so that it is charged for operation as a condenser for absorbing heat.

The shells of the container may be formed from metal, while the insulation may be an aluminized plastic film. For lower temperature requirements, such as for storage of biological samples, the shells may be formed from glass fiber material including portions formed into a honeycomb structure, and the surfaces facing the space lined with a metal foil to minimize heat leak through the walls to the contents of the container, and having a liner including a phase change material and a pre-charged refrigerant coil for charging and prolonging the phase change material in its charged condition.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 2:
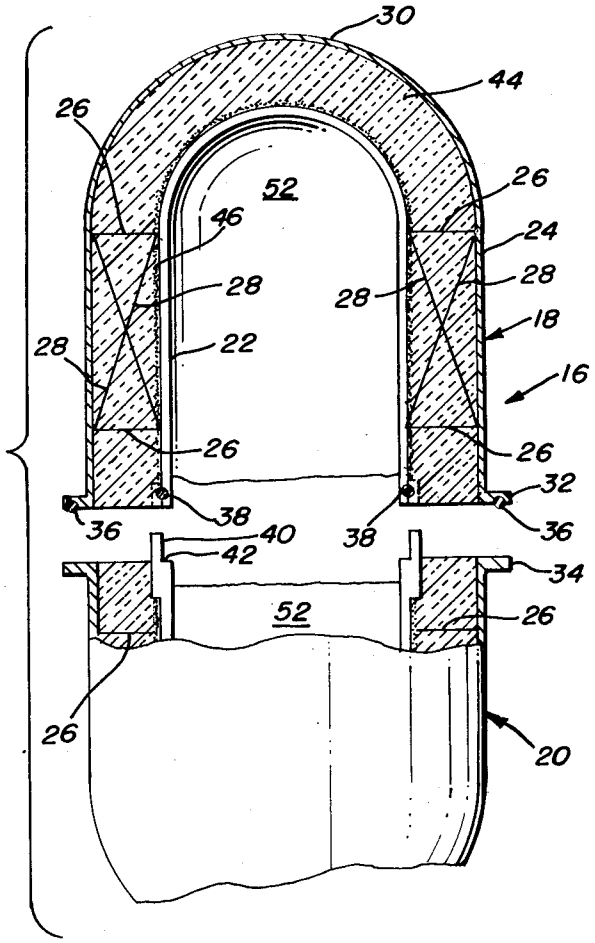
FIG. 2 is a fragmentary longitudinal cross sectional view of the food storage container illustrated in FIG. 1, the two parts of the container being disassembled and a portion of one part being illustrated in elevation.

Referring to the drawings, a logistics module for common use with the manned orbiting space station and the space shuttle is illustrated generally at 10, the module being adapted to be carried by the shuttle from earth to orbit for transfer to the space station for use, and thereafter returned by the shuttle to earth. The module comprises a rack having a plurality of storage chambers 12 each of which has a hollow cylindrical configuration including a closeable door 14 for sealing the chamber when closed. A storage container 16, as hereinafter described, is warehoused and carried in the module to and from the orbiting space station by the space shuttle.

Figure 1:
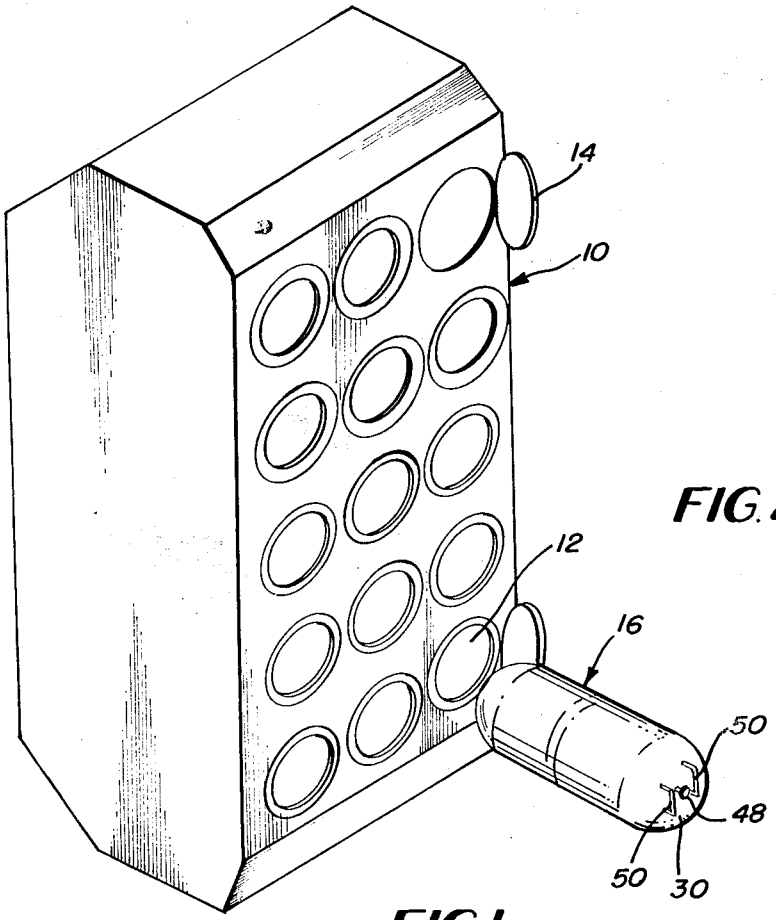
FIG. 1 is a diagrammatic perspective view of a storage container and a logistics module for warehousing the food storage container to and from orbit, the container being constructed in accordance with the principles of the present invention.

The storage container 16 illustrated in FIG. 1 may be a unit for storing frozen food or the like, the construction of the container being illustrated in FIG. 2. For this application the storage container comprises two substantially similar elongated units 18, 20 adapted for assembling together. Each unit 18, 20 includes an inner shell 22 received within an outer structural shell 24, the shells comprising metallic material such as steel or aluminum and being structurally connected together by means of a plurality of transverse wire support members 26 and a plurality of diagonally disposed wire braces 28, the wires preferably being stainless steel or the like which are connected to the shells by welding or by other conventional means. Each shell 22, 24 of each unit 18, 20 has a cylindrical configuration opening at one end and disclosed at the opposite end, the closed end 30 preferably having a dome configuration as illustrated. The open end of each outer shell 24 includes a respective externally disposed flange 32, 34, and one of the flanges, e.g., flange 32 has a circumferential slot within which a seal in the form of an O-ring 36 is disposed. Another seal, this being a sliding O-ring seal 38, is disposed about the periphery of one of the inner shells 22, e.g., the inner shell associated with the unit 18, while the inner shell associated with the other unit, e.g., unit 20, includes a peripheral rim 40 extending longitudinally of the open end of the unit. The rim 40 is stepped outwardly from the inner shell of the unit 20, such as at 42, an amount such that it may be received about the outer periphery of the inner shell 22 of the unit 18 within the space between the shells and engage the seal 38 in a tight sealing relationship.

Disposed within the space between the respective inner and outer shell 22, 24 is a multi- layer insulation material 44, the material 44 being a thin film continuous wrap plastic sheet material having metallic film surfaces. An example of such a material is a MYLAR brand polyethylene film having thin film aluminized surfaces. The plastic film acts as an insulator between the shells 22, 24 to reduce conductive heat transfer while the aluminum film acts as a series of radiation shields to reduce the transfer of heat by radiation. Also disposed within the space between the shells is a chemical getter material, illustrated on the outer surface of the inner shell 22 at 46, the getter being any conventional trace gas material for purposes as hereinafter described.

At the dome end 30 of one of the units, as illustrated in FIG. 1, is a closeable vacuum pumping port 48 which communicates with the space between the shells 22, 24 and through which air can be evacuated and a vacuum drawn once the units are assembled. Handling lugs 50 may also be secured to the dome end of one of the units, preferably the same one having the port 48.

The food in a frozen state is placed within the storage chamber 52 of the inner shell of the units 18, 20 and the two halves are assembled by sliding the unit 20 into engagement with the unit 18 so that the rim 40 is positioned within the space between the shells 22 and 24 in sealing engagement with the seal 38 to seal the space from the food section while the seal 36 of the flange 32 acts to seal the space from the exterior of the units by sealing against the face of the flange 34. Thereafter a vacuum pump is connected to the port 48 to evacuate air from the space between the shells of both units to draw a vacuum therein, the vacuum being in the order of $10^{-4}$ torr. The pump is then withdrawn and the port closed. The getter material will absorb any trace gasses remaining in the vacuum space.

The assembled container may thereafter be stored in a chamber 12 of the module 10 for flight aboard the shuttle to the space station. By using a sufficient amount of the insulation described and by drawing a sufficient vacuum, it is expected that during the nominal 90 day mission the temperature of the food will not rise above a −20° F. requirement. However, if necessary, a phase change material liner as hereinafter described in regard to the biological sample storage container, may be utilized about the inner shell 22. Once the module 10 reaches the space station, the crew may periodically retrieve a container 16 from the module, open the port 50 to break the vacuum, open the container and store its contents in the habitat refrigerator/freezer unit on board the space station.

Figure 3:
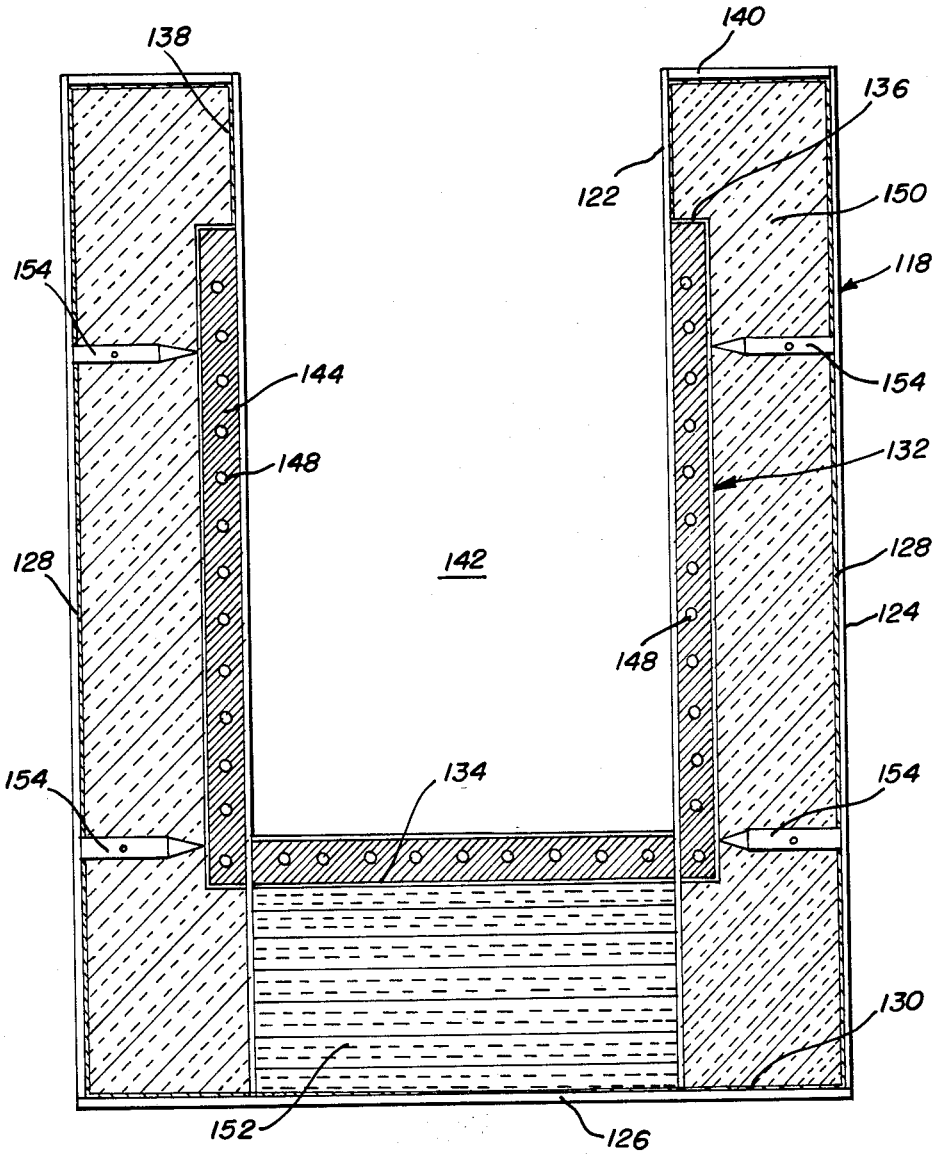
FIG. 3 is a diagrammatic cross sectional view of half of a storage container for storing material such as biological samples at extremely low temperatures for transfer to and from orbit constructed in accordance with the principles of the present invention.

For the more stringent temperature restrictions required for storage of biological samples, the container 16 may be formed from two units 118, and since both units are identical, only one unit is illustrated in FIG. 3. The units are similar to the units in the prior embodiment, but because the biological samples must be stored at approximately −95° F. during transfer to and from orbit, the materials and construction details differ somewhat from the prior embodiment. Thus, although each unit comprises an inner storage shell 122 and an outer shell 124, these shells are constructed from glass fiber material such as that sold under the brand name FIBERGLAS, some of which is in a honeycomb form, and additional structural elements must therefore be utilized to strengthen the structure. Additionally, a phase change material liner is required together with a charging coil.

Accordingly, referring to FIG. 3, each half or unit 118 of the storage container includes an outer shell 124 comprising glass fiber material compressed into a stable structure and formed into an elongated hollow cylindrical configuration, the thickness of the form being in the order of approximately 0.125 inch, while the inner shell 122 is similarly formed but of a thickness in the order of approximately 0.030 inch. Additionally, the length of the inner shell 122 is substantially the same as the outer shell and extends to meet the closed end 126. The closed end 126 of the container is constructed from glass fiber formed into a honeycomb structure of approximately 0.25 inch, i.e., walls connected together by interconnecting wave-shaped baffles forming cells therebetween, the honeycomb providing substantial structural strength and integrity relative to the cylindrical portions of the shells and is attached to the adjacent end of the shells as by gluing, bonding or the like.

Disposed about the interior surface of the outer shell 124 is a metallic liner 128 preferably formed from stainless steel foil of a thickness in the order of approximately 0.5 mil. A similar liner at 130 is disposed about the interior surface of the honeycomb end wall 126. Mounted within the space between the shells 122, 124 is a metal liner 132 also preferably formed from stainless steel foil of approximately 0.5 mil. thickness, this liner is spaced a short distance from the inner shell and extends toward the closed end 12 where it forms a bottom wall 134 spaced from the closed end of the inner shell. The liner 132 has a rim 136 which closes onto the inner shell spaced from the open end of the container so that the liner forms a cavity between it and the inner shell. Another preferably stainless steel foil liner 138 extends upwardly toward the open end of the container along the outer wall of the inner shell 122 from the rim 136 toward the open end in substantial abutment with an annular honeycomb glass fiber annular wall 140 extending within the inner and outer shells 122, 124 at the closed end. Thus, all of the glass fiber material which faces the space between the inner and outer shells along one surface and having its other surface facing either the exterior of the container or the interior storage space 142 has a metallic liner. This provides structural integrity to the container while also precluding molecular flow of gasses or the like through the glass fiber structure. Additionally, the metallic liners act as heat shields to minimize heat leak to the material stored in the space 142.

Filling the cavity between the inner shell 122 and the liner 132 is a phase change material 144, the material being any material which changes from a solid to a liquid state at a substantially constant temperature. Paraffin wax and lithium chloride are examples of such materials which may be utilized, but these are by way of example only and are not to be considered as a limitation of the invention or the materials therefor. To charge or freeze the phase change material condenser (or capacitor) a refrigerant cooling coil 148, which may be copper tubing, is disposed throughout the phase change material and may be filled with a cold gas such as nitrogen. Nitrogen under high pressure may be expanded to lower its temperature and pass into and fill the coil 148 prior to launch and, if required, the coil may be recharged at the space station. The refrigerant coil not only charges but acts to maintain the phase change material in its charged condition for a longer period.

The longitudinally extending space between the shells 122, 124, as in the first embodiment, is filled with a multi-layer insulation material 150, this material also being a thin film continuous wrap plastic having metallic film surfaces. However, the section 152 between the shells 122, 124 and between the portion of the inner shell 122 which is extended toward the honeycomb end wall 126 is filled with a multi-layer insulation of the same material as the material 150, but this is formed into multi-layered disks rather than continuous wrap so as to fit properly within the geometric confines of that space. Furthermore, to add additional structural integrity to the container structure, a plurality of struts 154 may extend transversely between the inner and outer shells, the struts 154 being formed from glass fiber material into substantially cylindrical members having a diameter in the order of approximately 0.375 inch.

Two units 118 with the samples in the storage space 142 are connected together along the annular honeycomb opened ends, and a vacuum is drawn in the space between the shells 122, 124 in a manner similar to that in the first embodiment. Of course, here also a getter material should be incorporated in the space between the respective inner and outer chambers for absorbing trace gasses trapped therein.

Accordingly, the present invention provides a passive, long term storage capability for frozen and refrigerated food and for very low temperature biological samples. It therefore eliminates the various fluid/thermal and electrical interfaces with the logistics module etc. while still providing the low temperatures required for the mission.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container for storing frozen products for long durations, said container comprising two units adopted for connecting together, each of said units comprising an elongated outer shell having an open end and a closed end, an elongated inner shell having an open end and a closed end, said inner shell being disposed within and spaced from said outer shell with the respective closed ends and inner ends in juxtaposition, said inner shell defining a storage chamber for said products, support means for connecting said shells together in spaced apart relationship to provide a hollow between said shells, a multi-layer insulation disposed in said hollow, said insulation comprising plastic sheet material having metallic film surfaces for limiting heat transfer by conduction and by radiation between said shells, getter material disposed in said hollow, means for connecting said open ends of the shells of one unit to the open ends of the other unit while communicating the hollow of one unit with the hollow of the other unit, and closeable port means attached to the outer shell of at least one unit and communicating with the hollow therein for evacuating air from the hollow of both units when said units are connected together for providing a vacuum in said hollow.

2. A container as recited in claim 1, wherein said inner and outer shells of each unit are metallic.

3. A container as recited in claim 1, including cooperating seal means associated with the inner and outer shells of the respective units for sealing the hollow from the storage chamber of both unit and from the exterior of the outer shells.

4. A container as recited in claim 1, wherein said insulation comprises a continuous wrap of sheet material having metallic film surfaces.

5. A container as recited in claim 2, wherein the closed ends of said shells have a dome configuration.

6. A container as recited in claim 2, wherein said insulation comprises a continuous wrap of sheet material having metallic film surfaces.

7. A container as recited in claim 6, including cooperating seal means associated with the inner and outer shells of the respective units for sealing the hollow from the storage chamber of both units and from the exterior of the outer shells.

8. A container as recited in claim 7, wherein the closed ends of said shells have a dome configuration.

9. A container as recited in claim 6, wherein said support means comprises wire braces connecting to and extending from the inner surface of the outer shell to the outer surface of the inner shell.

10. A container as recited in claim 1, including wall means disposed intermediate said inner and outer shells and defining a cavity with the outer surface of said inner shell, said cavity containing a material which changes phase from a solid to a liquid at substantially constant temperature.

11. A container as recited in claim 1, wherein said inner and outer shells of each unit comprise glass fiber material.

12. A container as recited in claim 11, wherein the closed end of each of said outer shells has a honeycomb construction.

13. A container as recited in claim 11, wherein all surfaces of said shells which face said hollow include a metallic foil liner.

14. A container as recited in claim 13, including wall means disposed intermediate said inner and outer shells and defining a cavity with the outer surface of said inner shell, said cavity containing a material which changes phase from a solid to a liquid at substantially constant temperature.

15. A container as recited in claim 14, wherein said space includes tubing in the form of a coil, said tubing containing a low temperature refrigerant.

16. A container as recited in claim 15, wherein the closed end of each of said outer shells has a honeycomb construction.

17. A container as recited in claim 16, wherein said support means comprises glass fiber struts extending in said hollow between said inner and outer shells.

* * * * *